US005542657A

United States Patent [19]

Kemmerer et al.

[11] Patent Number: 5,542,657

[45] Date of Patent: Aug. 6, 1996

[54] GRIPPER APPARATUS FOR SHEET-FED PRINTING MACHINES

[75] Inventors: Klemens Kemmerer, Selignestadt; Harald Bayer, Rodgau; Valentin Gensheimer, Muhlheim, all of Germany

[73] Assignee: MAN Roland Druckmaschinen AG, Germany

[21] Appl. No.: 271,478

[22] Filed: Jul. 7, 1994

[30] Foreign Application Priority Data

Jul. 1, 1993 [DE] Germany ..... 43 21 850.4

[51] Int. Cl.[6] ..... B65H 29/06

[52] U.S. Cl. ..... 271/82; 271/276

[58] Field of Search ..... 271/276, 204, 271/206, 85, 268, 82

[56] References Cited

U.S. PATENT DOCUMENTS 5,199,757 4/1993 Simeth ..... 271/82
5,303,650 4/1994 Wieland ..... 271/204

FOREIGN PATENT DOCUMENTS 101353 11/1973 Germany .
2725035C3 11/1979 Germany .
3623405C2 2/1988 Germany .
3739169C1 6/1989 Germany .
4026237C1 2/1992 Germany .
4239254 5/1994 Germany ..... 271/268

*Primary Examiner*—William E. Terrell
*Assistant Examiner*—Tamara Kelly
*Attorney, Agent, or Firm*—Leydig, Voit & Mayer, Ltd.

[57] ABSTRACT

A semishell-shaped gripper apparatus for sheet-fed printing machines includes a gripper of low mass, which is fastened without play on the gripper shaft and minimizes the sliding of the gripper tip on the printing carrier. This is achieved by having the gripper finger surround the gripper shaft in such a way that separate effective engagement surfaces are formed. The effective engagement surfaces are disposed on the gripper shaft with frictional engagement and, in conjunction with the resultant force, form a triangle of forces. The gripper holder has a depression running parallel to the gripper shaft connecting to the lower edge of a web on the gripper finger in a releasably positive-locking manner. The gripper tip has a raised holding surface which has tapering radii on its periphery.

9 Claims, 4 Drawing Sheets

GRIPPER APPARATUS FOR SHEET-FED PRINTING MACHINES

FIELD OF THE INVENTION

The present invention relates generally to a gripper apparatus for gripping sheets of paper on a cylinder in a sheet-fed printing machine.

BACKGROUND OF THE INVENTION

A semishell-shaped sheet gripper of this general type is known from DE 3,623,405 C2. The gripper consists of a box-shaped gripper finger and a carrier whose respective ends, adjacent the transfer point, are spread apart by means of a compression spring. An adjusting screw is arranged at the opposite end to regulate the spacing. The carrier is fastened by means of a screw on the gripper actuating shaft which also carries the gripper finger. Due to the box shape, the gripper finger forms an integral peripheral surface which constitutes an effective bearing surface on the gripper shaft. This gripper apparatus is easy to assemble, but has an unfavorable gripper finger geometry. The gripper finger encounters play on the gripper shaft resulting in a tendency of the gripper finger and, thus the gripper tip, to slide due to the position of the gripper tip in the triangle of effective forces. Due to the peripheral surface interacting with the gripper shaft, a high break-away moment is produced during opening and closing which also contributes to the sliding of the gripper tip during closing.

DD-WP 101 353 also discloses a semishell-shaped sheet gripper which has a guide groove between the gripper spindle and the gripper finger paired with a guide ring or guide ball. Additionally, two springs are positioned opposite each other. The disadvantage of this gripper arrangement is high manufacturing costs as well as unreliable lateral guiding of the gripper finger.

DE-C-2,725,035 discloses a sheet gripper having a special gripper shaft contour. The disadvantage of this disclosure is that it is very expensive to manufacture the gripper shaft. Moreover, the holding force is difficult to adjust.

The design of a rounded gripper tip is known from DE 3,739,169 C1, which has a bead with a radius of 0.4 to 1.0 mm, which is coated with a mechanically resistant material and runs parallel to the leading edge of the sheet. It is disadvantageous in that a high surface pressure occurs due to the bead-like elevation as a result of the linear contact with the printing carrier during closing. This surface pressure leaves impressions or imprints in the printing carrier and the gripper tip tends to displace the printing carrier, especially when relatively thin paper is used.

OBJECTS AND SUMMARY OF THE INVENTION

The object of the present invention is to appreciably minimize those disadvantages mentioned. Pursuant to the present invention, a sheet gripper is provided whose tendency to slide upon the gripper pad during the opening and closing of the gripper finger is essentially negligible.

The gripper of the present invention is preferably designed as a semishell-shaped gripper wherein the gripper finger partially surrounds the circumferential surface of the gripper shaft. Separate effective surfaces on the gripper finger contact the gripper shaft in order to absorb the friction moments. These effective surfaces preferably extend over the width of the gripper finger in the direction parallel to the axis of the gripper shaft.

Also in accordance with the present invention, the gripper finger is guided without play on the gripper shaft and cannot be tilted or removed from the gripper shaft. Any tolerances between the gripper finger and the gripper shaft are compensated for and the inclination of the gripper tip to slide upon the printing carrier is substantially reduced. In the preferred embodiment, the gripper has a low mass and a high rigidity with a high holding force as a result of the bias provided by the compression spring.

Pursuant to a further aspect of the invention, the gripper holder is secured to the gripper shaft and provides a platform on which the compression spring can be mounted. The compression spring forces the effective surfaces of the gripper finger towards the gripper shaft. In the preferred embodiment and as described in more detail below, the inner corner of the web on the gripper finger forms a releasable positive-locking connection with a depression slot which runs along the length of the upper surface of the gripper holder. An adjusting element is also provided to support the gripper finger against the gripper holder. These three features interacting between the gripper finger and gripper holder enhance the rigidity of the novel gripper apparatus of the present invention. Moreover, due to its simplicity of design and construction, assembly and disassembly times are appreciably reduced.

The gripper apparatus of the present invention achieves the desired goals mentioned above due to the locations of the resultant force in both the opened and closed state. In the preferred and illustrated embodiment, the resultant forces in both the closed state ($P_S$) and in the open state ($P_A$) are substantially radial in direction and pass through the gripper shaft adjacent to one another. The resultant forces are determined by the arrangement of the adjusting screw, the compression spring and the holding surface which will be described further below in connection with the preferred embodiment.

These and other features and advantages of the invention will be more readily apparent upon reading the following description of a preferred exemplified embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF PREFERRED EMBODIMENT

Figure 1:
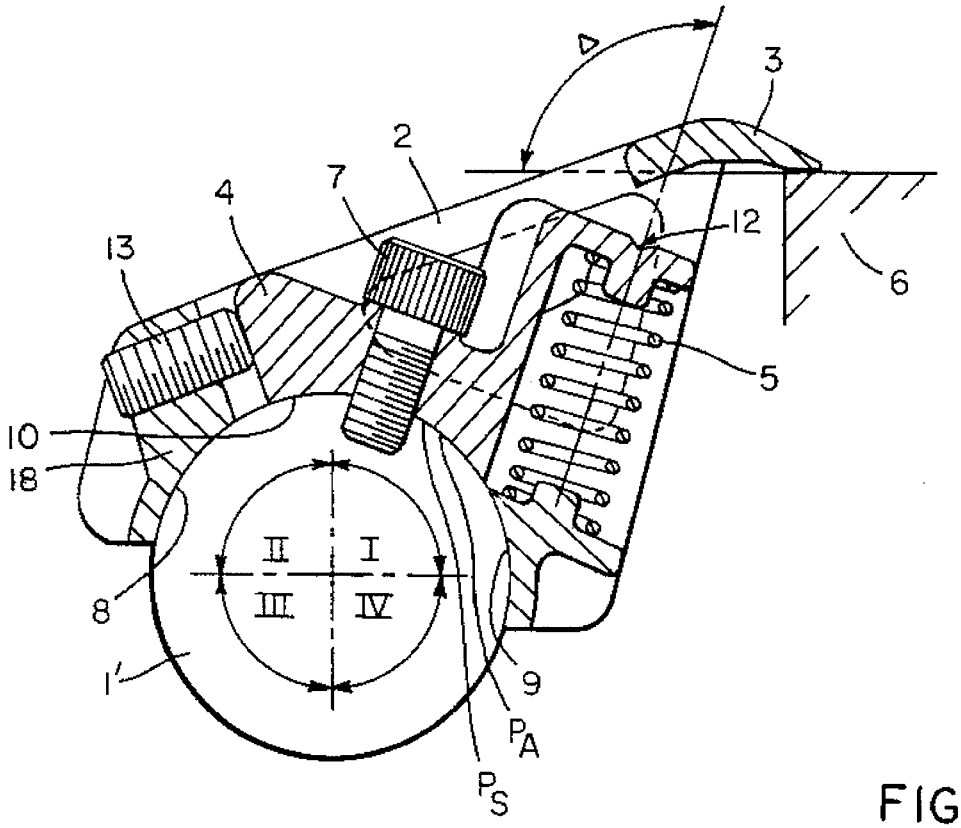
FIG. 1 shows a sectional view of the gripper apparatus of the present invention in the closed state with the tip of the gripper finger firmly engaging a holding surface on a cylinder of a printing machine.

Referring now in more particular to FIG. 1, a gripper apparatus for use on a cylinder of a printing machine is shown. In the preferred and illustrated embodiment, a semi-shell-shaped gripper apparatus is arranged on a gripper shaft 1, surrounding the gripper shaft sectors labeled I–IV at the top by roughly 180°. It will be understood, that the gripper shaft 1 is mounted in a sheet conveying cylinder of a printing machine. Preferably, the grippers are spaced longitudinally on the gripper shaft 1 and are arranged to operatively engage the gripper pads 6 on the periphery of a sheet-conveying cylinder.

In accordance with the present invention, the gripper apparatus consists of a gripper finger 2 which has a box shape when viewed from the top. The gripper finger 2 has a cylindrical cutout when viewed from the side through which the gripper shaft 1 is placed. Separate effective surfaces 8, 9 of the gripper finger 2 are frictionally engaged with the gripper shaft 1. In the preferred embodiment, the gripper finger 2 has a cutout 11 between the effective surfaces 8, 9 through which a gripper holder 4 protrudes with its surrounding surface 10 in contact with the gripper shaft 1. The gripper holder 4 is arranged between the outer side walls 17 of the gripper finger 2 and secured to the gripper shaft 1 by means of a lock screw or bolt 7.

Pursuant to the invention, a compression spring 5 and an adjusting element 13, which could be a bolt or screw, interact between the gripper finger 2 and the gripper holder 4. The adjusting element 13 is screwed into a threaded bore located in a rear cross web 18 which connects the side walls 17 at the top of the gripper finger 2. This adjusting element 13 supports the gripper finger 2 against the gripper holder 4 in the circumferential direction with respect to the gripper shaft 1. The compression spring 5 is arranged between the gripper finger 2 and the gripper holder 4 on the side opposite the adjusting element 13 below the gripper pad 6.

Figure 4:
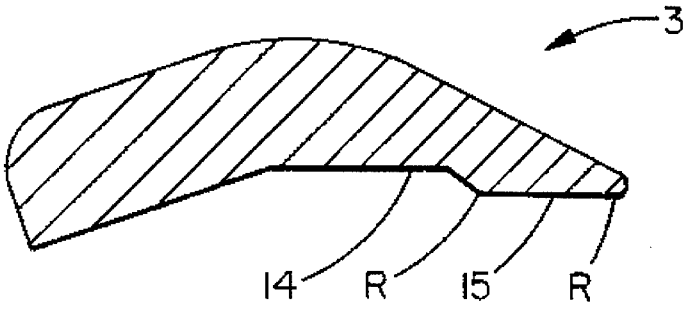
FIG. 4 is an enlarged partial sectional view of the gripper tip.
Figure 5:
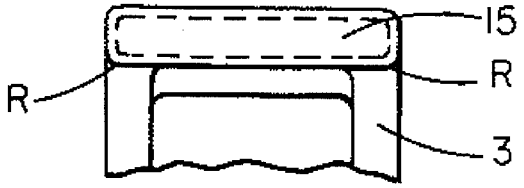
FIG. 5 is a fragmentary illustration of the holding surface of the gripper tip as viewed from below.

At the end of the gripper finger 2 is a gripper tip 3, which in the preferred embodiment is integral with the gripper finger 2. It will be understood, however, that the gripper tip 3 could be fabricated as a separate element attached to the gripper finger 2. In the closed position, the underside of the gripper tip 3, which has a holding surface 15, operatively engages the gripper pad 6 on the printing machine cylinder. The holding surface 15 is raised from the gripper tip 3 and tapers from the gripper tip 3 by tapering radii R. The radii R of the holding surface 15 are preferably within the range of 0.6 to 1.6 mm. In the preferred embodiment, the radii R defining the holding surface 15 running parallel to the gripper shaft 1 are greater than the radii R running parallel to the side walls 17. This has the advantage that the holding surface 15 on the gripper finger tip 3 has a soft impact with the printing carrier during closing. The radius R adjacent to the gripper shaft 1 at the gripper tip 3 preferably has an undercut 14 and tapers away therefrom as shown by FIG. 4.

Pursuant to the present invention, a web 16 connects the side walls 17 of the gripper finger 2 on the side of the gripper tip 3 pointing in the direction of the gripper shaft 1. Also on the side corresponding to the compression spring 5, the gripper holder 4 has a depression 12 running parallel to the gripper shaft 1 on its upper side. This depression 12 constitutes a releasable positive-locking connection with the lower edge of the web 16 and prevents slippage of the gripper finger 2 on the gripper shaft 1.

To further reduce the movement friction and thus the break-away moment of the gripper finger 2 relative to the gripper shaft, the effective surfaces 8, 9 preferably have integrated lubrication recesses. Alternatively, plain-bearing materials may be incorporated into the effective surfaces 8, 9 to reduce the friction and thus reduce wear between the gripper finger 2 and the gripper shaft 1.

Figure 2:
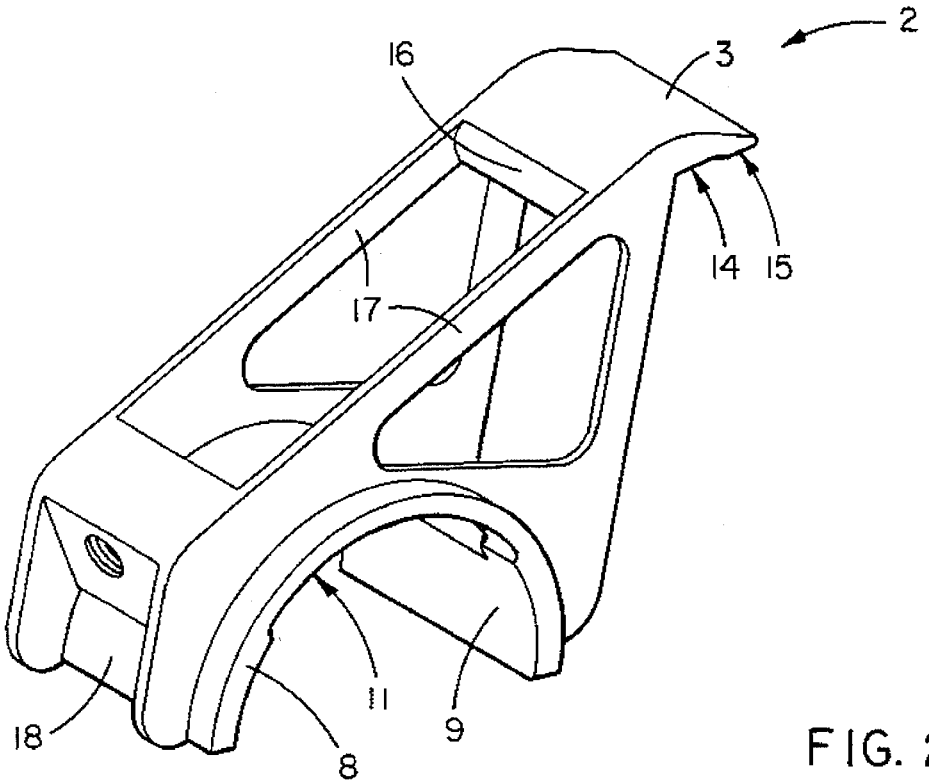
FIG. 2 is a perspective illustration of the gripper finger shown in FIG. 1.
Figure 3:
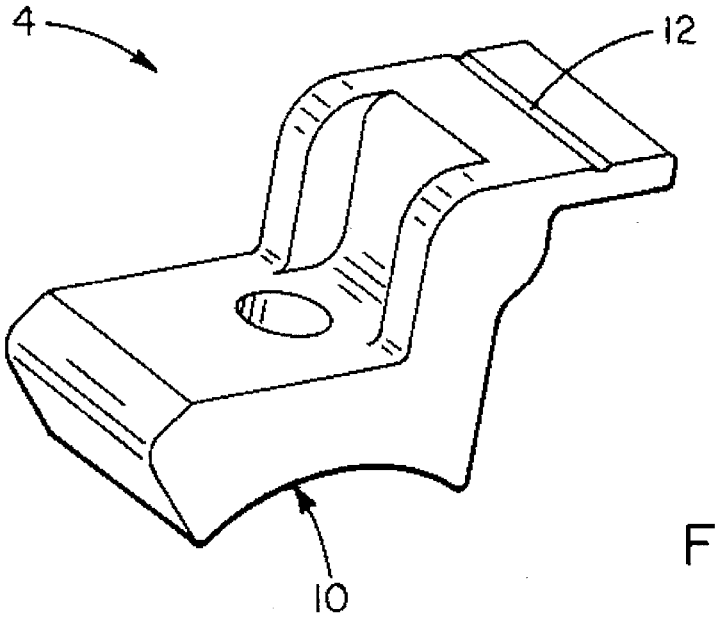
FIG. 3 is a perspective illustration of the gripper holder shown in FIG. 1.
Figure 6:
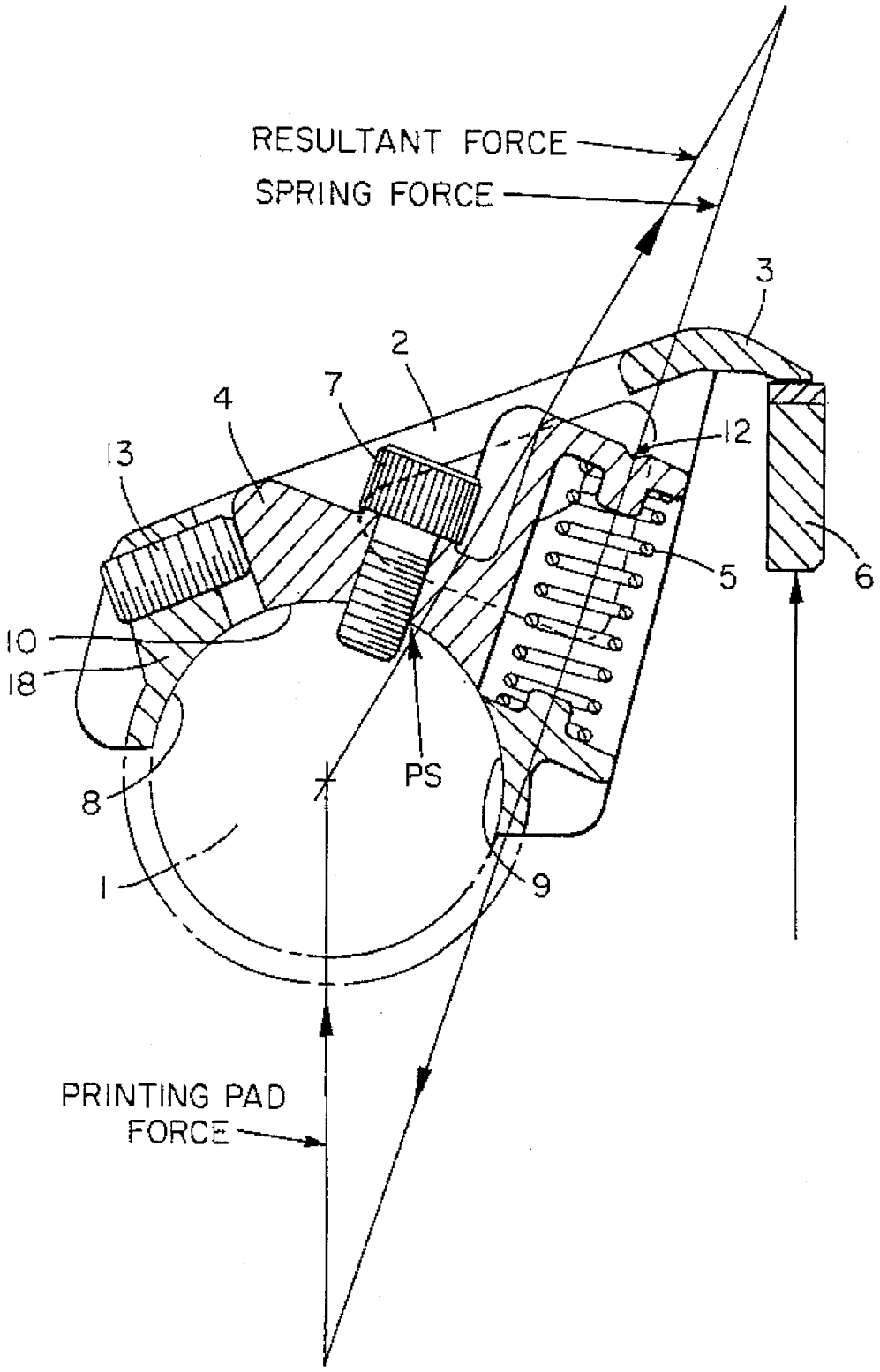
FIG. 6 is an illustration showing the interacting forces on the gripper in the closed state ($P_S$)
Figure 7:
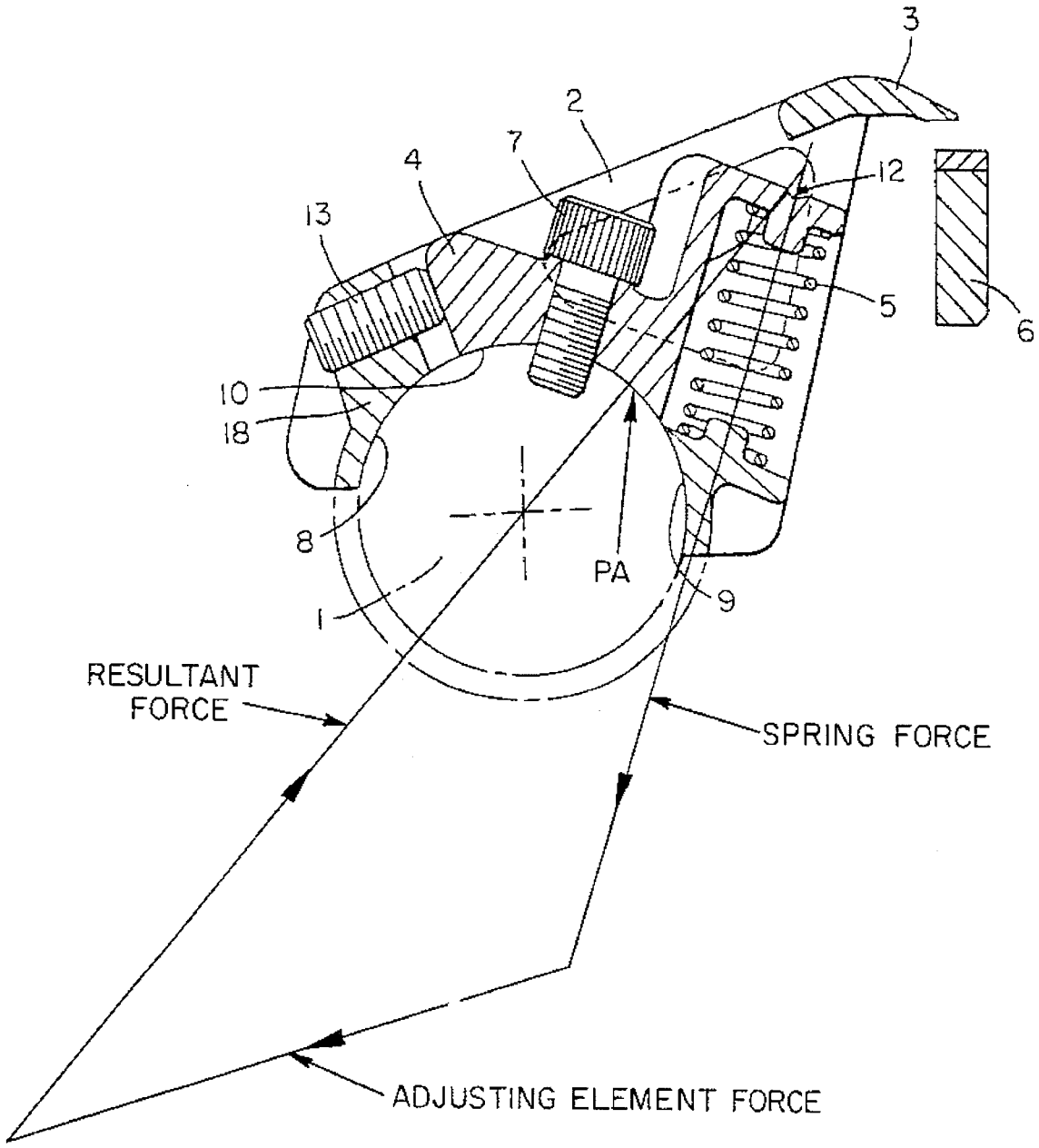
FIG. 7 is an illustration showing the interacting forces on the gripper in the opened state ($P_A$).

As shown in FIG. 1, in the preferred embodiment, the gripper shaft 1 is divided into quadrants I to IV. The effective surface 8 is located in the IInd quadrant and the effective surface 9 is located between the Ist and IVth quadrants. Between the effective surfaces 8 and 9, which are in contact with the shaft 1, the gripper finger 2 has a cutout 11 as shown in FIG. 2. Together with the resultant force passing through the center-point of the gripper shaft 1, the effective surfaces 8 and 9 form a triangle of forces. In keeping with the invention, the resultant forces with the gripper closed ($P_S$) and with the gripper open ($P_A$) lie on the circumference of the gripper shaft 1 as closely as possible to one another in the Ist quadrant as is shown by FIGS. 6 and 7. In the preferred embodiment, about ⅓ of the forces are absorbed by the effective surface 8 and about ⅔ of the forces are absorbed by the effective surface 9.

By way of further explanation of the invention, the forces occurring in the opening or closing phase, from $P_A$ to $P_S$ or vice versa, are formed by the combination of:

adjusting element 13 with a center-line running through the gripper finger tip 3, screw 7 securing the gripper holder 4 to the gripper shaft 1 with a center-line (in the Ist quadrant) running through the center-point of the gripper shaft 1, compression spring 5 with a center-line touching the gripper shaft 1 (in the direction of the spring base), preferably in the region of the effective surface 9, and (in the direction of the spring head) intersecting the gripper tip 3 in a region facing away from the gripper pad 6, holding surface 15 which runs at an angle Δ greater than 90° relative to the center-line of the compression spring 5.

From the foregoing it will be appreciated that the beneficial effects of the present invention arise from the location of the resultant forces on the gripper shaft 1 during both the opened and closed state of the gripper finger 2. As illustrated in FIG. 6, the resultant force on the gripper finger 2 in the closed state is produced from the force exerted on the gripper tip 3 from the gripper pad 6 and the force of the compression spring 5. Similarly, in the opened state, as illustrated in FIG. 7, the resultant force on the gripper finger 2 is produced from the compression spring 5, which has now been relieved, and the adjusting element 13. It will be appreciated, of course, that the effects of the adjusting element 13 are substantial only during the opened state since the compression spring 5 upon relief pulls the gripper finger 2 in a clockwise direction and the adjusting element 13 resists this tendency for rotation as shown by FIG. 7.

Because the resultants in the opened and closed state intersect the circumference of the gripper shaft 1 under the gripper holder 4 in close proximity to one another, the change in force exerted on the gripper finger 2 during transition is minimal. This minimal force fluctuation is ideal since the gripper finger tip 3 will experience little, if any, undesirable sliding on the gripper pad 6 when engaging the same. This provides for accurate printing while maintaining the integrity of the leading edge of the sheet of paper.

It should also be understood that, if desired, the gripper can also be designed in a full shell shape for particular applications such as to increase safety at work. The gripper finger 2 then surrounds the gripper shaft 1 around the circumference and has the same cutout 11 near the top between the effective surfaces 8, 9. The cutout 11 near the top could optionally be assigned a congruent cutout at the bottom between the effective surfaces 8, 9.

In a further alternative and optional embodiment, the two effective surfaces can also be designed as an integral effective surface. In this case, the effective bearing surface surrounds the gripper shaft in a sector and forms a perigon with the cutout near the top.

We claim as our invention:

1. A gripper apparatus for gripping a sheet of paper in a sheet-fed printing machine which includes a cylinder having an axis-parallel recess in the periphery thereof, a cylindrical gripper shaft disposed for rotation within said recess about an axis parallel to said axis-parallel recess, and a gripper pad located on the circumference of said cylinder at the edge of said recess on which the leading edge of a paper sheet is disposed, said gripper apparatus comprising, in combination, a gripper finger including a pair of arcuately shaped base surfaces conforming to and disposed in circumferentially spaced-apart relation less than 180 degrees from each other on said gripper shaft and having a gripper finger tip structure protruding substantially radially from said gripper shaft, said base surfaces defining a substantial circumferential open space therebetween, sheet engagement means disposed on said radially protruding tip structure of said finger for securing one of said sheets of paper on said gripper pad of said cylinder, a gripper holder having an arcuately shaped fastening surface secured to said shaft and disposed in said circumferential open space between said base surfaces of said finger and conforming to and disposed on said gripper shaft, said gripper holder including biasing spring means connected to said finger for opposing a force on said finger when said gripper tip engages said gripper pad, releasable alignment connection means disposed above the effective line of said spring means forming a releasable positive connection directly between said gripper finger and said gripper holder thereby precluding skewed alignment between said finger and said holder relative to said shaft axis after said gripper finger tip engagement means returns to a non-engaged position from said engaged position with said gripper pad, and adjusting means for opposing the force of said biasing spring means when said gripper finger tip engaging means is not engaged with said gripper pad, said adjusting means, spring means, and sheet engagement means are arranged such that a change in force exerted on said gripper finger is minimal during a transition of said gripper finger in a open state and closed.

2. A gripper apparatus as defined in claim 1, wherein said adjusting means includes a threaded screw disposed within said gripper finger and screwed against said gripper holder.

3. A gripper apparatus as defined in claim 1, wherein said base surfaces of said gripper finger include integral lubrication reservoirs for reducing friction between said base surfaces and said gripper shaft.

4. A gripper apparatus as defined in claim 1, wherein said base surfaces of said gripper finger include bearing elements for reducing friction between said base surfaces and said gripper shaft.

5. A gripper apparatus as defined in claim 1, wherein said gripper tip engagement means includes a flat holding surface on the underside of said gripper tip and curved-shaped edges parallel to the leading edge of said sheet of paper which form said holding surface.

6. A gripping apparatus as defined in claim 5, wherein said curved-shaped edges have radii in the range of 0.6 mm to 1.6 mm.

7. A gripper apparatus for gripping a sheet of paper in a sheet-fed printing machine which includes a cylinder having an axis-parallel recess in the periphery thereof, a cylindrical gripper shaft disposed for rotation within said recess about an axis parallel to said axis-parallel recess, and a gripper pad located on the circumference of said cylinder at the edge of said recess on which the leading edge of a paper sheet is disposed, said gripper apparatus comprising, in combination, a gripper finger having a pair of arcuately shaped base surfaces conforming to and disposed in circumferentially spaced-apart relation less than 180 degrees from each other on said gripper shaft, and a gripper finger tip structure protruding substantially radially from said gripper shaft, said base surfaces defining a substantial circumferential open space therebetween, sheet engagement means disposed on said radially protruding tip structure of said finger for securing one of said sheets of paper on said gripper pad, wherein said gripper finger tip engagement means reacts to a force from said gripper pad in a direction tending to retract said gripper finger away from said gripper shaft, a gripper holder having an arcuately shaped fastening surface secured to said shaft and disposed within said circumferential open space between said base surfaces of said gripper finger, said gripper holder including biasing spring means connected to said finger forcing said finger toward said shaft and tending to rotate said finger about said shaft, said biasing spring means applying more force to said finger when said finger tip engagement means is effectuated to counterbalance said force from said gripper pad, releasable alignment connection means disposed above the effective line of said spring means forming a releasable positive connection directly between said gripper finger and said gripper holder thereby precluding skewed alignment between said finger and said holder relative to said shaft axis after said gripper finger tip engagement means returns to a non-engaged position from said engaged position with said gripper pad, and adjusting means for opposing said rotational motion of said gripper finger about said gripper shaft produced by said biasing spring means when said gripper finger tip engaging means is not engaged with said gripper pad, said adjusting means, spring means, and sheet engagement means are arranged such that a change in force exerted on said gripper finger is minimal during a transition of said gripper finger in a open state and closed.

8. A gripper apparatus as defined in claim 7, wherein said gripper finger tip engagement means is effectuated by rotation of said gripper shaft thereby producing an engagement resultant force created from said biasing spring means and said gripping pad force, said engagement resultant force being disposed to intersect said gripper shaft axis and said fastening surface of said holder, and when said gripper tip engagement means is not in engagement with said gripper pad, a non-engagement resultant force is created from said biasing spring means and said adjusting means, said non-engagement resultant force being located to intersect said gripper shaft axis and said fastening surface of said holder at a point near, but not overlapping said intersection of said gripper finger engagement resultant.

9. A gripping apparatus as defined in claim 8, wherein said gripper shaft is subjected to cyclic, reciprocal angular rotation of less than 45 degrees causing said engagement of said gripper finger tip engagement means on said gripper pad, and said gripper finger maintains accurate alignment without slippage on said gripper pad due to the close proximity of said resultant engagement force and said resultant non-engagement force.

* * * * *